US006733403B2

(12) United States Patent
Courtright

(10) Patent No.: US 6,733,403 B2
(45) Date of Patent: May 11, 2004

(54) BASKETBALL RETURN APPARATUS

(75) Inventor: Gary B. Courtright, Westerville, OH (US)

(73) Assignee: Fast Break Sporting Goods, Westerville, OH (US)

( * ) Notice: Subject to any disclaimer, the term of this patent is extended or adjusted under 35 U.S.C. 154(b) by 0 days.

(21) Appl. No.: 10/201,474

(22) Filed: Jul. 23, 2002

(65) Prior Publication Data

US 2004/0018898 A1 Jan. 29, 2004

(51) Int. Cl.[7] ..... A63B 69/00
(52) U.S. Cl. ..... 473/433; 473/431
(58) Field of Search ..... 473/433, 432, 473/435, 434

(56) References Cited

U.S. PATENT DOCUMENTS 3,427,026 A * 2/1969 Mahoney ..... 473/435
3,456,945 A * 7/1969 Epply ..... 473/435
3,711,092 A * 1/1973 Hogue ..... 473/435
5,265,870 A 11/1993 Merino
5,273,276 A 12/1993 Warren
5,409,211 A 4/1995 Adamek
5,443,258 A 8/1995 Kinsella
5,540,428 A 7/1996 Joseph
5,779,569 A 7/1998 Townsend et al.
6,056,652 A 5/2000 Lees et al.
6,074,313 A 6/2000 Pearson
6,209,877 B1 4/2001 Warnick
6,224,503 B1 5/2001 Joseph
6,250,634 B1 * 6/2001 Strain et al. ..... 273/395
6,537,161 B2 * 3/2003 Manix et al. ..... 473/433

* cited by examiner

*Primary Examiner*—Stephen P. Garbe
*Assistant Examiner*—M. Chambers
(74) *Attorney, Agent, or Firm*—Gallagher & Dawsey Co. LPA; Michael J. Gallagher; David J. Dawsey

(57) ABSTRACT

A basketball return apparatus designed to return a thrown basketball substantially in the direction of the player shooting the ball is mounted beneath a basketball goal assembly and includes a resilient rebound panel, a panel retainer assembly, and a panel support assembly. The resilient rebound panel, in multiple embodiments, is provided with flexible and adjustable tensile connections to the goal assembly that allows a limited degree of rotation when the resilient rebound panel is impacted by a thrown basketball. The rotational motion of the rebound panel and the resilience of the rebound panel, combined with the tension and untensioning of the flexible and adjustable tensile connections to the goal assembly, tends to return a thrown basketball substantially back towards the player shooting the ball. The basketball return apparatus is adjustable for a plurality of heights and angles of return, and is easily removable from the field of play.

20 Claims, 8 Drawing Sheets

BASKETBALL RETURN APPARATUS

TECHNICAL FIELD

The present invention relates to the field of basketball return devices; particularly, to devices that are easily mounted and dismounted from a basketball goal assembly and act to return a basketball thrown towards a basketball goal apparatus to a player shooting the ball.

BACKGROUND OF THE INVENTION

The development of proficiency in any sport requires many hours of practice and many repetitions of basic skills. The sport of basketball poses several particular hardships to any aspiring player willing to spend the many hours necessary to improve his or her game. First, the development of shooting skills requires a nearly countless number of repetitions of shooting acts performed from varying distances and angles towards the goal apparatus, more commonly called the "net." Second, the ball is often deflected away from the shooter as it rebounds off the backboard, rim, other parts of the goal, or misses the goal apparatus entirely, called an "air ball." Even if the ball passes cleanly through the net, backspin or topspin on the ball can cause the ball to be irregularly reflected when it strikes the playing surface beneath the net. Lastly, while many of these problems are minimized by having another person retrieve shot balls, it can be difficult for a player to recruit another person to practice with, and sharing practice time with another person will decrease the amount of practice that a single player could gain on his or her own in an equivalent time period.

What has long been needed is a simple and inexpensive mechanical device, that can easily be located in an operational position for practice and then removed entirely or moved to a unobtrusive position for actual play, that reflects a basketball shot, regardless of whether the shot is errant or scoring, and which tends to reflect the basketball back towards the shooter.

Many attempts have been made to satisfy these needs. One general class of devices might be considered to utilize a net capture system. Examples of these devices include U.S. Pat. No. 6,074,313 to Pearson, and U.S. Pat. Nos. 5,540,428 and 6,224,503 to Joseph. In addition to being extremely bulky, these net capture device have several other drawbacks and do not have the versatility of the present invention. Net capture systems either tend to return the ball to a fixed position, as with the Joseph '428 device, or to return the ball in no particular place or direction, as with the Pearson '313 device. Further, the Pearson '313 device will not return balls that fall straight down through the net, and the Joseph '428 and '503 devices partially block and obscure the basketball goal from certain angles. Similar such devices are U.S. Pat. No. 6,267,696 to Mabe, and U.S. Pat. No. 6,056,652 to Lees, et al., which substantially also limit the possible shooting positions which can be taken relative to the net.

Another class could be denominated the hoop mounted director, such as that seen in U.S. Pat. No. 5,779,569 to Townsend, et al., U.S. Pat. No. 5,443,258 to Kinsella, or U.S. Pat. No. 5,409,211 to Adamek. These devices act to direct balls falling through the net into a scoop shaped trough that returns the ball in whichever direction the trough is aimed, which is not, of course, necessarily in the direction of the shooter. Also, these hoop mounted director devices are completely ineffectual for any ball not passing through the net. Another type is the ground mounted reflecting net, as seen in U.S. Pat. No. 6,209,877 to Warnick, which would require surface damaging fixation points to the floor or playing surface to be adapted to basketball use, as otherwise the reflector net will tend to tip over and slide away when it is struck by a ball. The relatively great distance, compared to a goal apparatus mounted device, at which a ground mounted reflector would lie relative to the basketball goal means that a very large reflector net would have to be employed to reliably receive even a portion of the missed shots. Additionally, balls that impact the net at an angle will generally be reflected away from the location in which the shot originated.

There are also flat plate reflecting systems designed to be mounted on the rim or on the goal supports. In the former category is U.S. Pat. No. 5,265,870 to Merino. The non-adjustable plate of Merino '870 will tend to reflect the ball away from the shooter, as the angle of reflection will be reciprocal to the angle of incidence, and thereby substantially defeat the utility of such a system. The rigid plate of Merino '870, being mounted to the rim support, will require an awkward reaching to a level of 10 feet, the height of a standard basketball rim and well above the reaching height of nearly any player, in order to put the device on, or take it off, the rim support structure. In the goal apparatus mounted class is, for example, U.S. Pat. No. 5,273,276 to Warren, which provides for a rigid reflecting plate that will allow the ball to bounce against the plate and be reflected to a pre-set position. The Warren '276 device requires that the player adjust the apparatus in advance to determine the point to which the ball will be returned. A player cannot move quickly between different shooting positions, since a re-positioning of the apparatus is required for each change in shooting position. The number of positions to which a ball can even be theoretically returned is limited by the number of azimuthal and elevation locking pin stops provided, unless the device is further fine tuned through its pivot points. A player would have to estimate, or learn through trial and error, which pin stops and pivot point fine tuning adjustments should be selected to accomplish a given direction of return. The rigid reflection plate is unlikely to reflect the ball any great distance, especially should the ball fall gently through the net. In a converse situation, when the ball strikes the reflecting plate with some force, especially if it strikes the plate near the edge, the rigid reflecting plate will directly transfer very large impact forces to the central pivot mounting. This will tend to cause a high level of wear, and possible breakage, by concentrating the force of a sudden impact at a single point.

Many of the shortcomings of the prior art result from the use in these goal assembly mounted devices of fixed attachments to the basketball goal apparatus. Such fixed points tend to restrict the direction in which the ball can be returned without cumbersome adjustments of the mountings, dissipate the kinetic energy which is needed for ball return, and concentrate undesirable loads at vulnerable points of the apparatus. The present invention, in contrast, uses flexible mounting attachments at several key points to the goal assembly, which allow the return apparatus a slight degree of rotational movement when struck by an incoming ball. This motion tends to re-direct the ball back to the shooter in a reciprocal direction to that of the incoming trajectory, or in other words, towards the shooter. This effect takes place as an incident of the design, and requires no adjustment of the apparatus to change the direction of reflection. As a result, the player is free to quickly vary his or her shot distance and angle, and yet still have the ball returned, without any adjustment of the return apparatus. Such flexible mountings also tend to conserve the momentum of the basketball during reflection for returning the ball and minimize the wear on the return apparatus. The device may be mounted within the reach of nearly any player, and can be easily removed or adjusted out of the way of the playing court from the goal apparatus if desired.

What continues to be needed but is missing from the field of basketball return devices is a lightweight device that reliably returns the basketball in the direction of the shooter, is easy to set-up, adjust, and is constructed to endure the abuse associated with repeated impacts. Further, the device must be easy to fabricate to ensure the apparatus is economical. While some of the prior art devices attempted to improve the state of the art of basketball return devices, none has achieved the cost optimized capability that is easy to fabricate and convenient to use of the present invention. With these capabilities taken into consideration, the instant invention addresses many of the shortcomings of the prior art and offers significant benefits heretofore unavailable.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations.

The basketball return apparatus of the present invention is designed to function with any of the numerous basketball goal assembly configurations commercially available. Generally, a basketball goal assembly includes a goalpost, at least one backboard support attached to a backboard and the goalpost, and a rim attached to the backboard.

In one of the many preferable configurations, the basketball return apparatus incorporates, among other elements, a resilient rebound panel positioned beneath the backboard, a panel retainer assembly adapted to flexibly and adjustably connect the upper section of the resilient rebound panel to the goal assembly, and a panel support assembly adapted to releasably and adjustably connect the lower section of the resilient rebound panel to the goal assembly. Numerous embodiments incorporate variations of the resilient rebound panel, the panel retainer assembly, and the panel support assembly.

In one of the many variations of the present invention, the resilient rebound panel may include a rebound panel frame upon which a resilient material may be secured. Additionally, the resilient material may include an elasticized membrane, a plurality of interconnected elasticized cords, or any of the myriad of resilient materials known to one skilled in the art.

Alternatively, the rebound panel may include a non-stretch material that is connected with elastic devices to the rebound panel frame. For example, but not limitation, the elastic devices connecting the frame to the material may includes springs, pneumatic cylinders, hydraulic cylinders, and bands constructed of virtually any resilient material.

The present invention incorporates unique panel retainer and support assemblies that assist in returning a basketball to the player at substantially the same angle with which the basketball approached the backboard. Numerous embodiments incorporate variations of the panel retainer assembly and the panel support assembly.

In one such embodiment, the panel retainer assembly incorporates at least one upper panel elastic retainer to flexibly and adjustably join the resilient rebound panel with the goal assembly. The at least one upper panel elastic retainer may be flexibly and adjustably joined to any component of the goal assembly. In one such variation two upper panel elastic retainers are used with each one secured to opposite ends of a rebound panel frame edge and secured to a common backboard support.

As with the panel retainer assembly, numerous panel support assembly variations exist. Perhaps the most simple panel support assembly includes at least one support brace that is releasably and adjustably connected to the goal assembly at one end via at least one support brace goal assembly mounting device, and is connected to the rebound panel at the opposite end. The connection of the support brace to the rebound panel is generally a rotatable connection, but may be rigid or flexible.

Now, with at least one variation of the rebound panel, retainer assembly, and support assembly described, the unique result of the unique components may be described. Generally, a player shooting at roughly a forty-five degree angle from the right side of the court would like the basketball to return to approximately the same location from which it was released. Typically a good basketball player will be able to shoot the basketball through the rim without the basketball hitting the rim. When this occurs the basketball will continue to substantially follow its flight path as it passes through the basketball net and beyond. Therefore, the basketball will strike the left half of the rebound panel. One unique advantage of the present invention is that when a basketball strikes the rebound panel at a location other than the center of the panel, the panel will rotate and the tension in one of the upper panel elastic retainers will increase while the tension in the opposite upper panel elastic retainer will decrease. Therefore, as the upper panel elastic retainer with the increased tension quickly returns to the pre-strike tension it returns the panel to the normal position thereby imparting a return angle of a substantially reciprocal direction on the basketball. This same basic principal applies to all the embodiments described herein.

In a further variation, the panel retainer assembly may incorporate at least one retainer brace having a distal end and a proximal end, at least one retainer brace goal assembly mounting device, and an upper retainer cross-member. The at least one retainer brace's distal end connects to the upper retainer cross-member, and the retainer brace's proximal end may be releasably and adjustable joined to the at least one retainer brace goal assembly mounting device. Additionally, the upper retainer cross-member may be flexibly and adjustably joined to the resilient rebound panel with at least one upper panel elastic retainer. An alternative embodiment may not include the upper retainer cross-member, and the resilient rebound panel may be flexibly and adjustably attached to the at least one retainer brace with at least one upper panel elastic retainer.

Additional variations may include alternative panel support assemblies that may incorporate at least one support brace having a distal end and a proximal end, at least one support brace goal assembly mounting device, and a lower retainer cross-member. The at least one retainer support brace's distal end connects to the lower retainer cross-member, and the at least one support brace's proximal end may be releasably and adjustably joined to the support brace goal assembly mounting device. Additionally, the lower retainer cross-member may be flexibly and adjustably joined to the resilient rebound panel with at least one lower panel elastic retainer. An alternative embodiment may not include the lower retainer cross-member, and the resilient rebound panel may be flexible and adjustably attached to the at least one support brace with at least one lower panel elastic retainer.

In yet a further variation the panel support assembly may include at least one panel vertical frame cross member connecting the resilient rebound panel to an adjustable intermediate support, a torsion device releasably and adjustably connecting the adjustable intermediate support brace to at least one support brace, and a support brace goal assembly mounting device releasably and adjustably connecting the at least one support brace to the goal assembly.

Further, any of the preceding embodiments may include at least one articulable adjustable support brace joint and at least one articulable adjustable retainer joint. Such joints would allow the rebound panel to be quickly and easily positioned beneath the backboard, as well as quickly and easily repositioned into a "storage position" that is out of the playing court and does not pose a danger to players. Additionally, adjustment of the articulable joints would allow the player to adjust the angle, and thereby the height, at which the ball is returned.

These variations, modifications, alternatives, and alterations of the various preferred embodiments, arrangements, and configurations may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

Also, in the various figures and drawings, the following reference symbols and letters are used to identify the various elements described herein below in connection with the several figures and illustrations: BB, BS, CS, GA, GP, N, P, Q1, Q2, R, RT, X, Y, and Z.

DESCRIPTION OF THE INVENTION

The apparatus for installing a frame and related appurtenances of the instant invention enables a significant advance in the state of the art of basketball return devices. The preferred embodiments of the apparatus accomplish this by new and novel arrangements of elements that are configured in unique and novel ways and which demonstrate previously unavailable but preferred and desirable capabilities.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
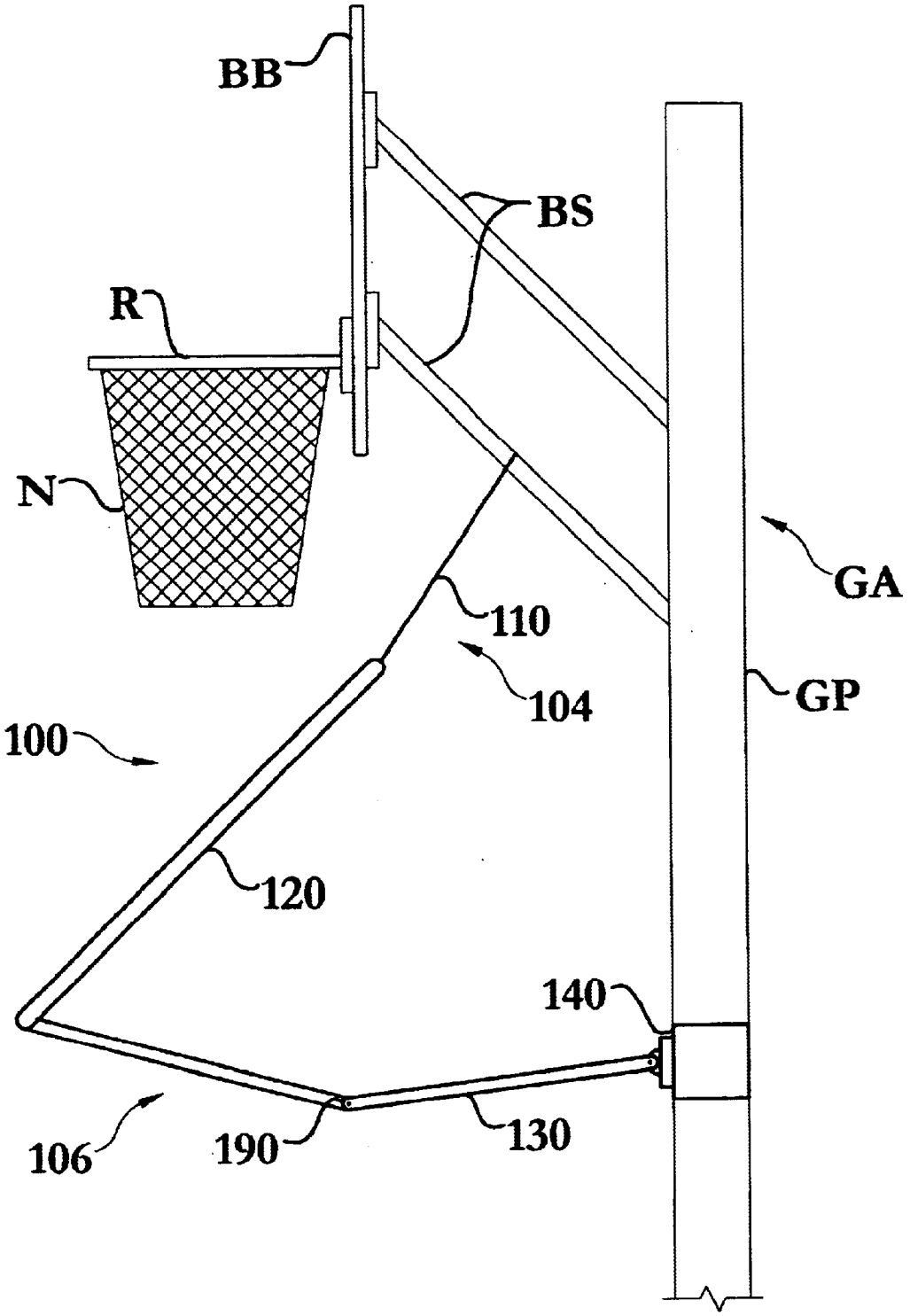
FIG. 1 is a detailed right side elevation view, in reduced scale, of the basketball return apparatus.
Figure 2:
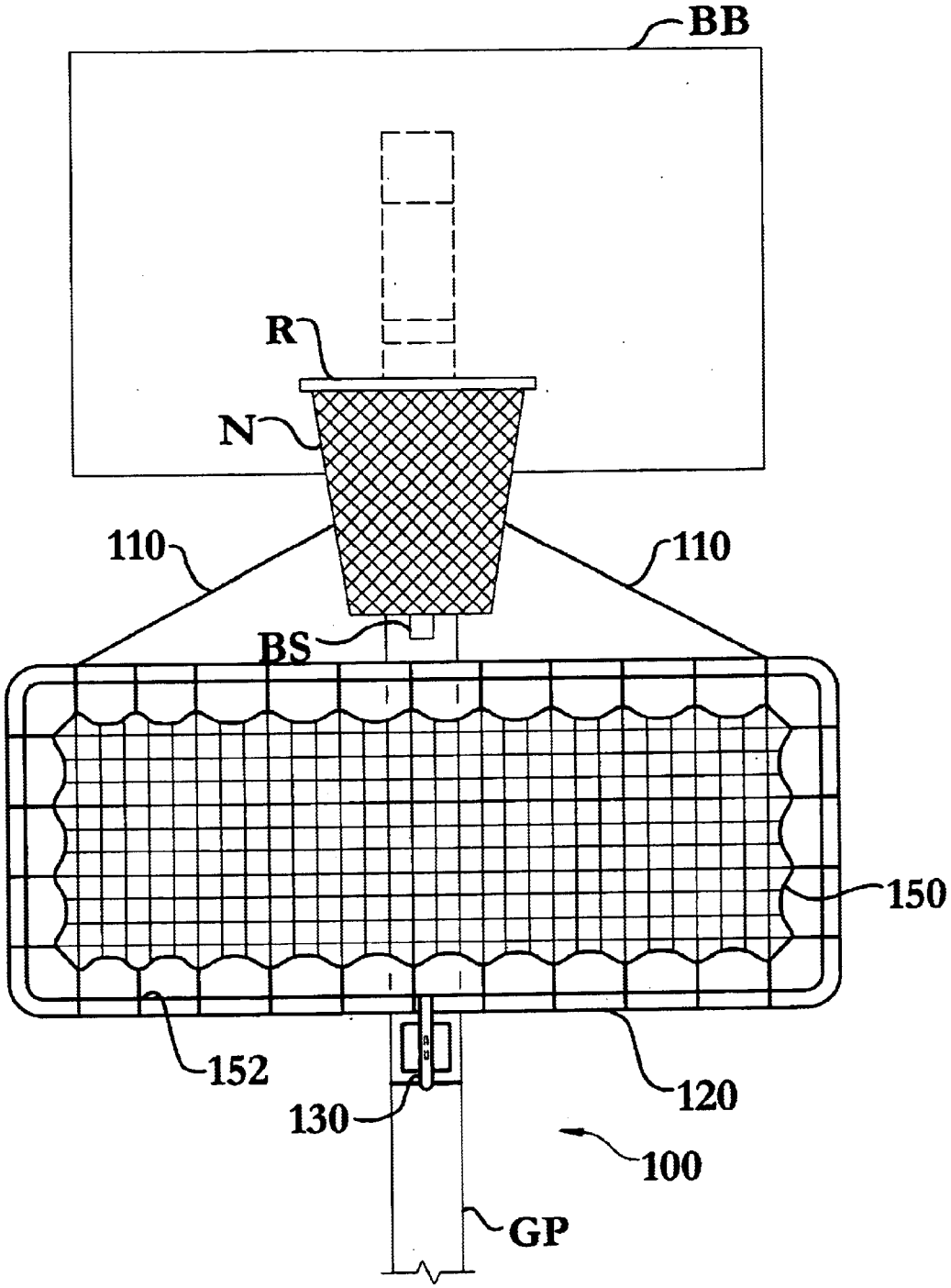
FIG. 2 is a detailed front elevation view, in reduced scale, of the basketball return apparatus shown in FIG. 1.

With reference now to the accompanying figures and specifically to FIG. 1 and FIG. 2, in one of the many preferable configurations, the basketball return apparatus 100, generally consisting of, among other elements, a resilient rebound panel 120 positioned beneath the backboard BB, a panel retainer assembly 104 adapted to flexibly and adjustably connect the upper section of the resilient rebound panel 120 to the goal assembly GA, and a panel support assembly 106 adapted to releasably and adjustably connect the lower section of the resilient rebound panel 120 to the goal assembly GA. Numerous embodiments incorporate variations of the resilient rebound panel 120, the panel retainer assembly 104, and the panel support assembly 106.

The resilient rebound panel 120 is the device that is located beneath the basket and reflects the basketball, as illustrated in FIG. 1 through FIG. 8. The resilient rebound panel 120 is resilient, meaning capable of withstanding shock without permanent deformation or rupture, in that it accepts the impact of the basketball, it is displaced by the impact, and then returns to the pre-impact position. In one of the many variations of the present invention, the resilient rebound panel 120 may include a rebound panel frame 152 upon which a resilient material 150 may be secured. As with the resilient rebound panel 120, the meaning of resilient in the term resilient material 150 means capable of withstanding shock without permanent deformation or rupture. Therefore, the resilient material 150 may be any material that accepts the impacts of the basketball, is displaced by the impact, and then returns to the pre-impact position. A person with average knowledge of textiles can easily identify a number of materials suitable for this embodiment ranging from polypropylene fibers to spandex. For instance, this embodiment may resemble the structure of a trampoline by having a jumping surface of woven resilient material connected to a perimeter frame by springs, or additional resilient devices. Additionally, the resilient material 150 may include an elasticized membrane, such as the surface of a trampoline, a plurality of interconnected elasticized cords, commonly used as stretchy netting used in rebounding a wide variety of balls and to retain loads in the bed of pick-up trucks, or any of the myriad of materials known to one skilled in the art. An elasticized cord is a long slender flexible material usually consisting of several strands woven or twisted together that is of an elastic nature, namely capable of being easily stretched or expanded and resuming former shape.

Alternatively, the rebound panel 120 may include a non-stretch material that is connected with elastic devices to the rebound panel frame 152. For example, but not limitation, the elastic devices connecting the frame 152 to the material may includes springs, pneumatic cylinders, hydraulic cylinders, and bands constructed of virtually any resilient material. In this embodiment, the non-stretch material may be a rigid solid surface that is attached to the rebound panel frame 152 with any of the aforementioned elastic devices. This embodiment is consistent with the meaning of resilient in the term resilient rebound panel 120 because while a portion of the rebound panel 120 may be rigid, the entire rebound panel 120 remains resilient, meaning capable of withstanding shock without permanent deformation or rupture, in that the rigid portion accepts the impact of the basketball, the rigid portion is displaced by the impact via the aforementioned elastic devices, and then the rigid portion returns to the pre-impact position. This can be analogized to a trampoline wherein the usual bouncing surface is replaced with a rigid solid surface attached to the trampoline frame with a plurality of springs. In this analogy a user would still be able to bounce on the rigid solid surface due to the resilient nature of the plurality of springs.

As shown in FIG. 2, the rebound panel frame 152 is preferably substantially rectangular and at least as wide as the backboard BB. However, the resilient rebound panel 120, and the rebound panel frame 152, may be of any size and shape.

The present invention incorporates unique panel retainer 104 and support 106 assemblies that assist in returning a basketball to the player P at substantially the same angle with which the basketball approached the backboard BB. Numerous embodiments incorporate variations of the panel retainer assembly 104 and the panel support assembly 106.

For example, as shown in FIG. 1 and FIG. 2, the panel retainer assembly 104 incorporates at least one upper panel elastic retainer 110 to flexibly and adjustably join the resilient rebound panel 120 with the goal assembly GA. The at least one upper panel elastic retainer 110 may be flexibly and adjustably joined to any component of the goal assembly GA. In one such variation, shown in FIG. 1 and FIG. 2, two upper panel elastic retainers 110 are used with each one secured to opposite ends of a rebound panel frame 152 edge and secured to a common backboard support BS. The functionality of the at least one upper panel elastic retainer 110 is best described later herein with reference to FIG. 8. As one with skill in the art would recognize from the figures and this disclosure, the at least one upper panel elastic retainer 110 is an elasticized cord, that is, a long slender flexible material usually consisting of several strands woven or twisted together, of an elastic nature, capable of being easily stretched or expanded and resuming former shape. Therefore, a layman will easily recognize that a standard bungee cord maybe modified to function as the at least one upper panel elastic retainer 110 of the present invention.

Figure 3:
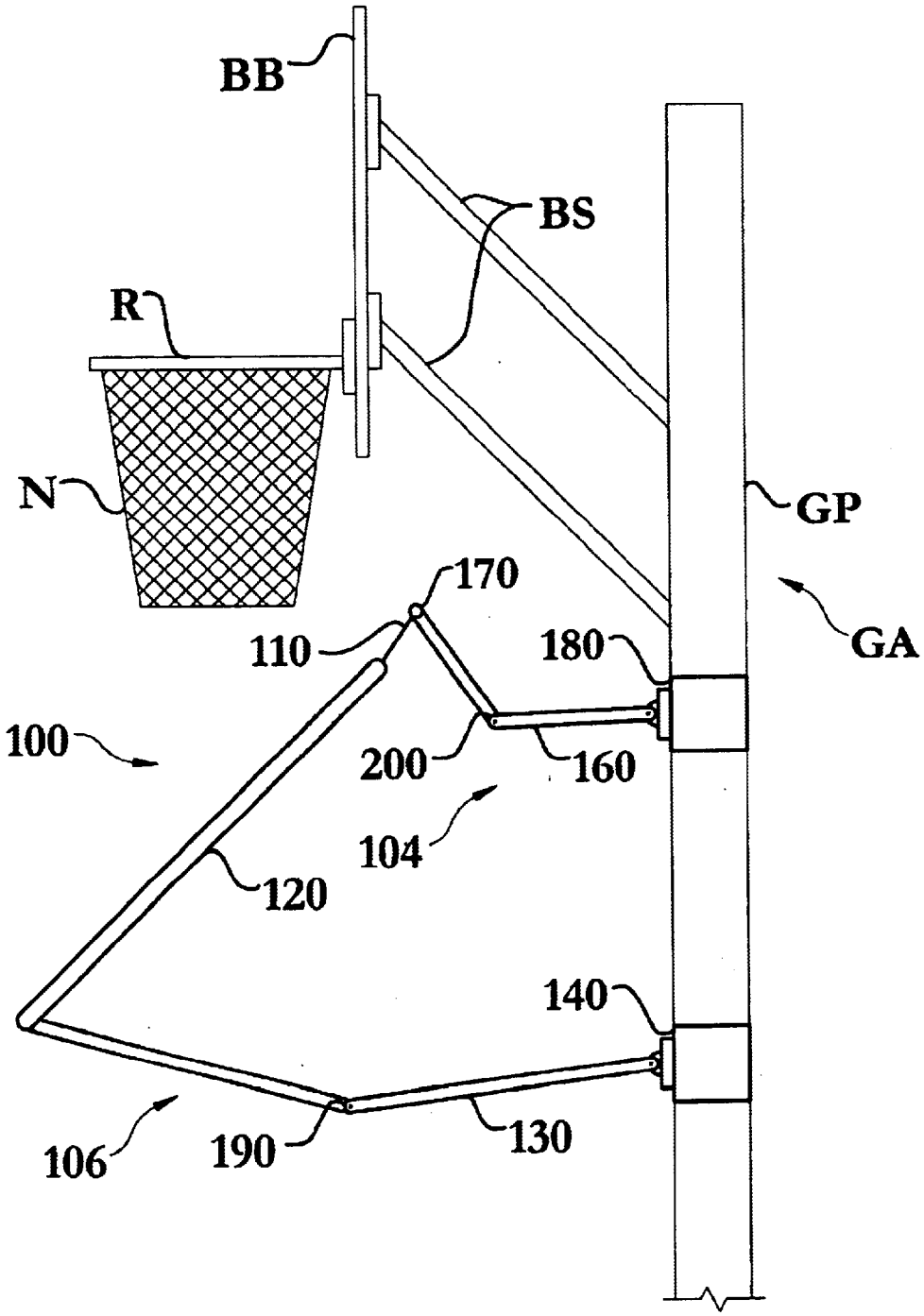
FIG. 3 is a detailed right side elevation view, in reduced scale, of a variation of the basketball return apparatus shown in FIG. 1.

As with the panel retainer assembly 104, numerous panel support assembly 106 variations exist. Perhaps the most simple panel support assembly 106 includes at least one support brace 130 that is releasably and adjustably connected to the goal assembly GA at one end via at least one support brace goal assembly mounting device 140, and is connected to the rebound panel 120 at the opposite end. In the most simple embodiment, the support brace 130 may consist of a single structural member such as tubing or conduit rotationally attached at one end to the at least one support brace goal assembly mounting device 140 and rotationally attached at the other end to the resilient rebound panel 120. In one particular embodiment the support brace 130, and virtually every other structural component of apparatus 100, is constructed of ¾" electrical metallic tubing (EMT). The connection of the support brace 130 to the rebound panel 120 is generally a rotatable connection, but may be rigid or flexible. The at least one support brace goal assembly mounting device 140 may be virtually any mechanical coupling that may lock onto the goal post GP and withstand the minimal load of the apparatus 100 and the basketball impacts, while also providing a convenient connection point for the panel support assembly 130. As illustrated in FIG. 3, the at least one support brace goal assembly mounting device 140 may simply be formed as a sleeve designed to cooperate with the shape of the goal post GP. Generally the at least one support brace goal assembly mounting device 140 will be a two piece assembly that is easily fit around and tightened to the goal post GP.

The at least one support brace goal assembly mounting device 140 may be configured in any number of ways to connect with any of the commercially available goalposts GP. For example, the mounting device 140 may be configured to mount to square, rectangular, or round goalposts GP.

Figure 8:
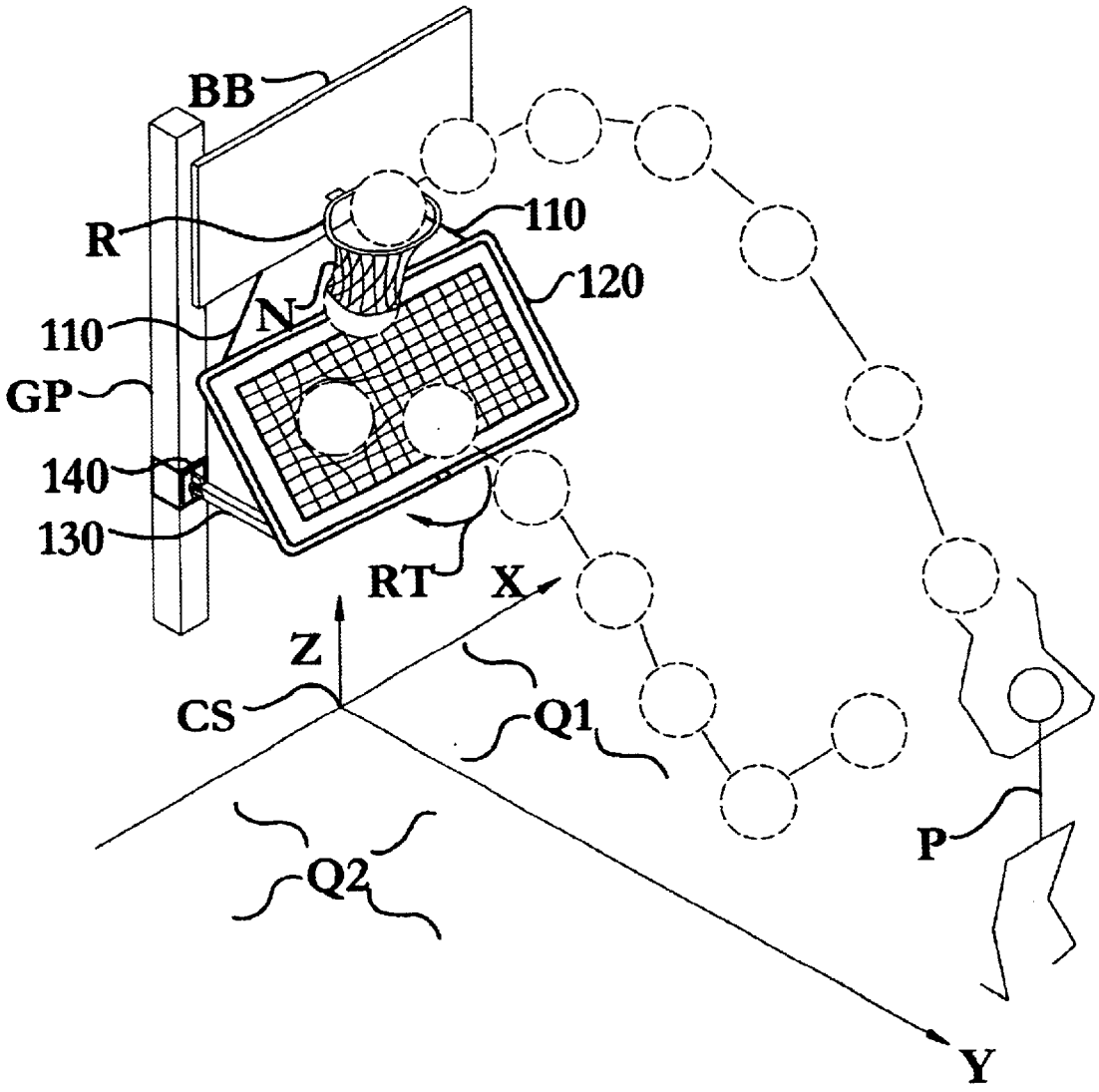
FIG. 8 is a detailed elevated perspective view, in reduced scale, of the basketball return apparatus shown in FIG. 1 in use.

Now referring to FIG. 8, the unique result of this apparatus 100 may be described. For example, during the course of practicing shooting basketball players often need to practice shoots that are not directly in front of the basket, i.e. at locations other than that along the Y-axis of the coordinate system CS shown in FIG. 8. Therefore, a player P shooting at roughly a forty-five degree angle from the right side of the court, between the positive X-axis and the positive Y-axis, also identified as quadrant number one Q1, would like the basketball to return to approximately the same location from which it was released. Typically a good basketball player P will be able to shoot the basketball through the rim R without the basketball hitting the rim R. When this occurs the basketball will continue to substantially follow its flight path as it passes through the basketball net N and beyond. Therefore, the basketball will strike the left half of the rebound panel 120. One unique advantage of the present invention is that when a basketball strikes the rebound panel 120 at a location other than the center of the panel 120, the panel 120 will rotate, as shown by rotation indicator RT, and the tension in one of the upper panel elastic retainers 110 will increase while the tension in the opposite upper panel elastic retainer 110 will decrease. Therefore, as the upper panel elastic retainer 110 with the increased tension quickly returns to the pre-strike tension it returns the panel 120 to the normal position thereby imparting a return angle of a substantially reciprocal direction returning the basketball to quadrant number one Q1. Conventional deflector plate type basketball return devices would typically return a ball shoot from quadrant number one Q1 to the opposite side of the court, quadrant number two Q2. This same basic principal applies to all the embodiments described herein. Additionally, the resilient rebound panel 120 may be formed in a substantially concave manner to assist in imparting the substantially reciprocal return angle.

Figure 4:
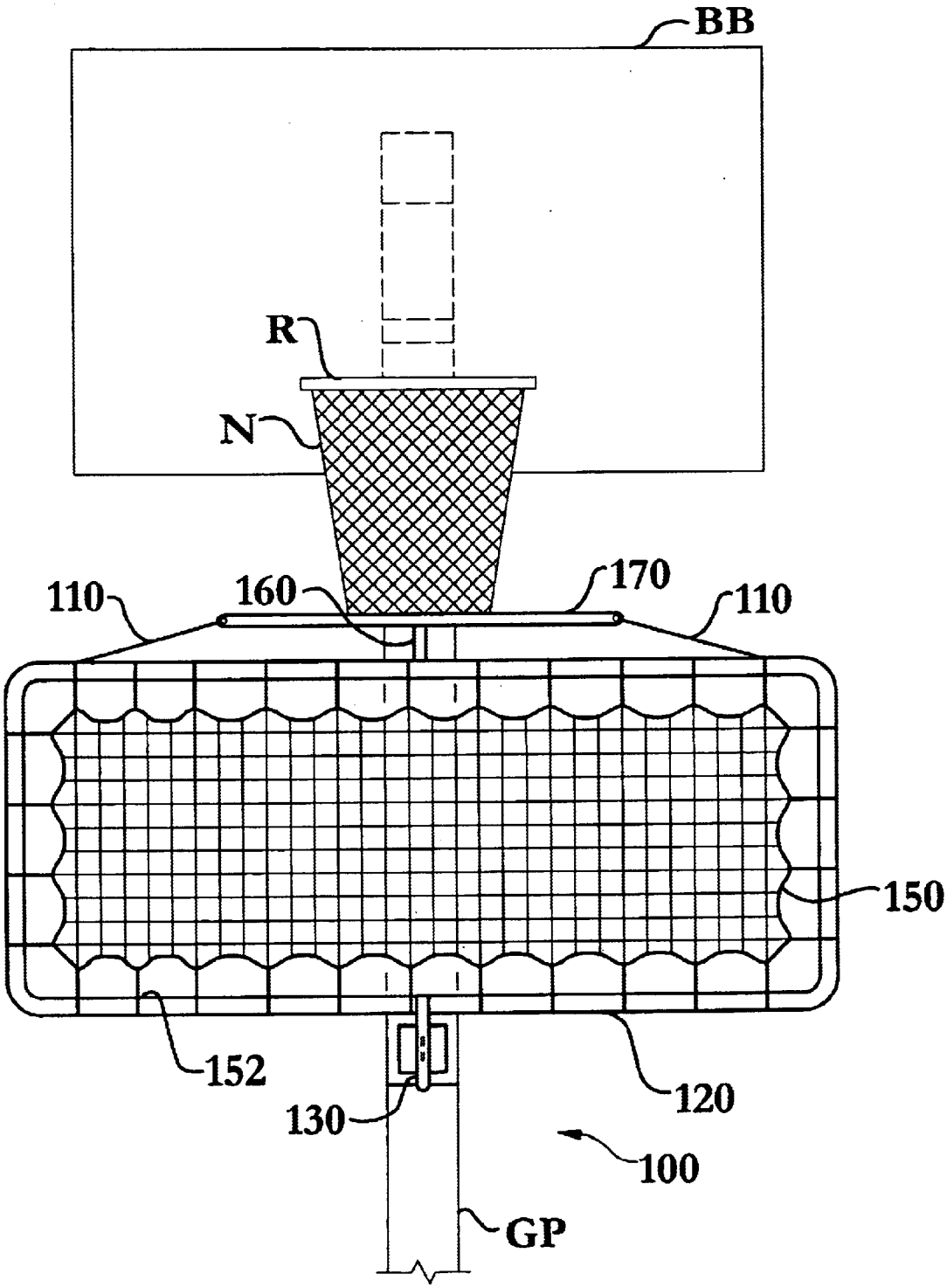
FIG. 4 is a detailed front elevation view, in reduced scale, of the basketball return apparatus shown in FIG. 3.

In a further variation intended to facilitate the mounting of the apparatus 100 solely from the goal post GP is illustrated in FIG. 3 and FIG. 4, wherein the panel retainer assembly 104 may incorporate at least one retainer brace 160 having a distal end and a proximal end, at least one retainer brace goal assembly mounting device 180, and an upper retainer cross-member 170. The retainer brace 160 is simply a structural member designed to transmit a portion of the load of the apparatus 100 to the goal assembly GA. In the most simple embodiment the retainer brace 160 may consist of a single structural member such as tubing or conduit. In one particular embodiment the retainer brace 160, and virtually every other structural component of apparatus 100, is constructed of ¾" electrical metallic tubing (EMT). The at least one retainer brace's 160 distal end connects to the upper retainer cross-member 170, and the retainer brace's 160 proximal end may be releasably and adjustable joined to the at least one retainer brace goal assembly mounting device 180. The upper retainer cross-member 170 functions solely as a spreader bar upon which the at least one upper panel elastic retainer 110 may be connected, as illustrated in FIG. 4. Additionally, the upper retainer cross-member 170 may be flexibly and adjustably joined to the resilient rebound panel 150 with at least one upper panel elastic retainer 110, given that the at least one upper panel elastic retainer 170 is elastic the connection is flexible and given that the at least one upper retainer cross-member 170 is connected to the retainer brace 160, which is adjustable. An alternative embodiment, not shown, may not include the upper retainer cross-member 170, and the resilient rebound panel 129 may be flexibly and adjustably attached to the at least one retainer brace 160 with at least one upper panel elastic retainer 110. The at least one retainer brace goal assembly mounting device 180 may be virtually any mechanical coupling that may lock onto the goal post GP and withstand the minimal load of the apparatus 100 and the basketball impacts, while also providing a convenient connection point for the retainer brace 160. As illustrated in FIG. 3, the at least one retainer brace goal assembly mounting device 180 may simply be formed as a sleeve designed to cooperate with the shape of the goal vest GP. Generally the at least one retainer brace goal assembly mounting device 180 will be a two piece assembly that is easily fit around and tightened to the goal post GP.

Figure 5:
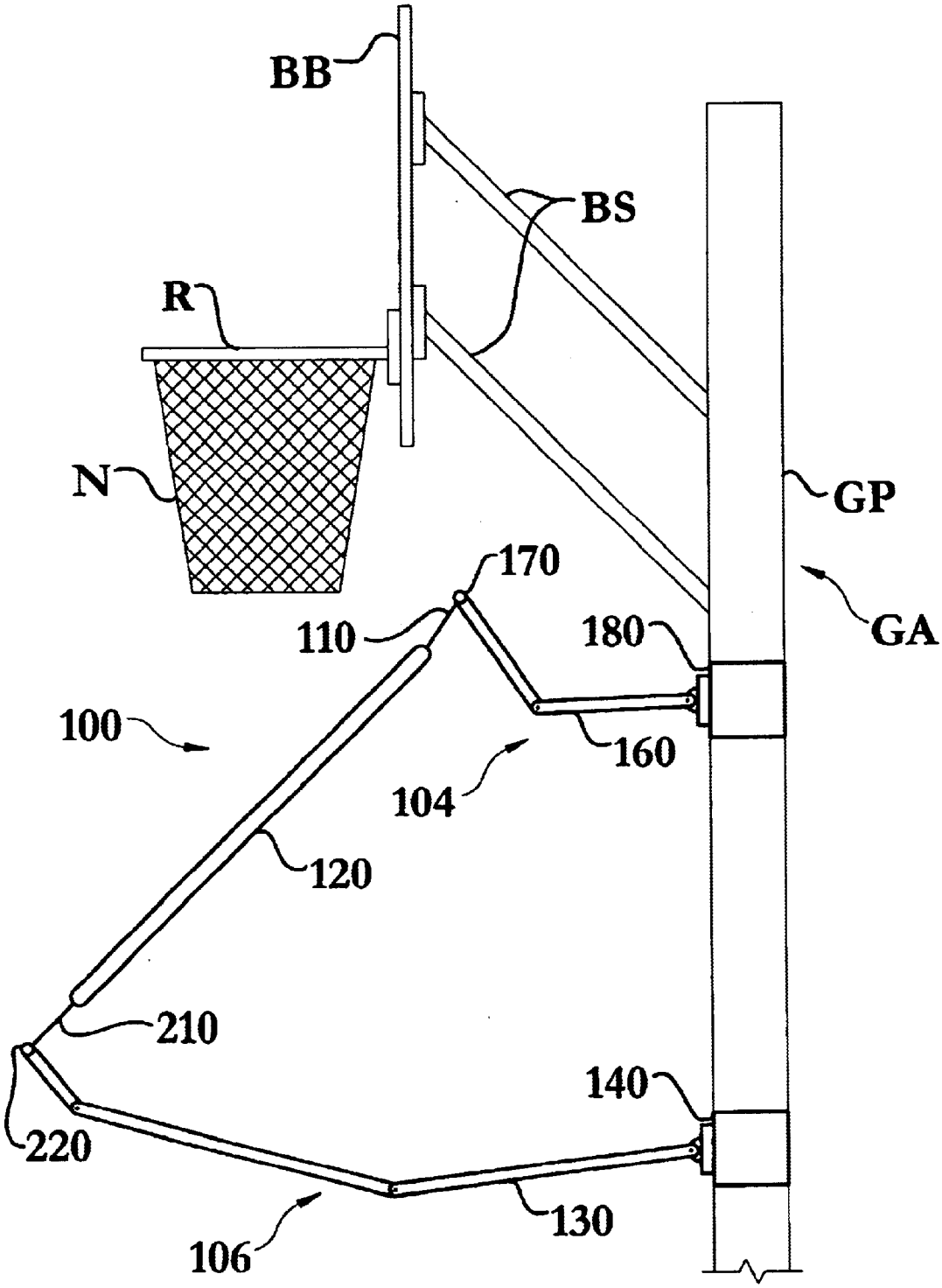
FIG. 5 is a detailed right side elevation view, in reduced scale, of a variation of the basketball return apparatus shown in FIG. 1.
Figure 6:
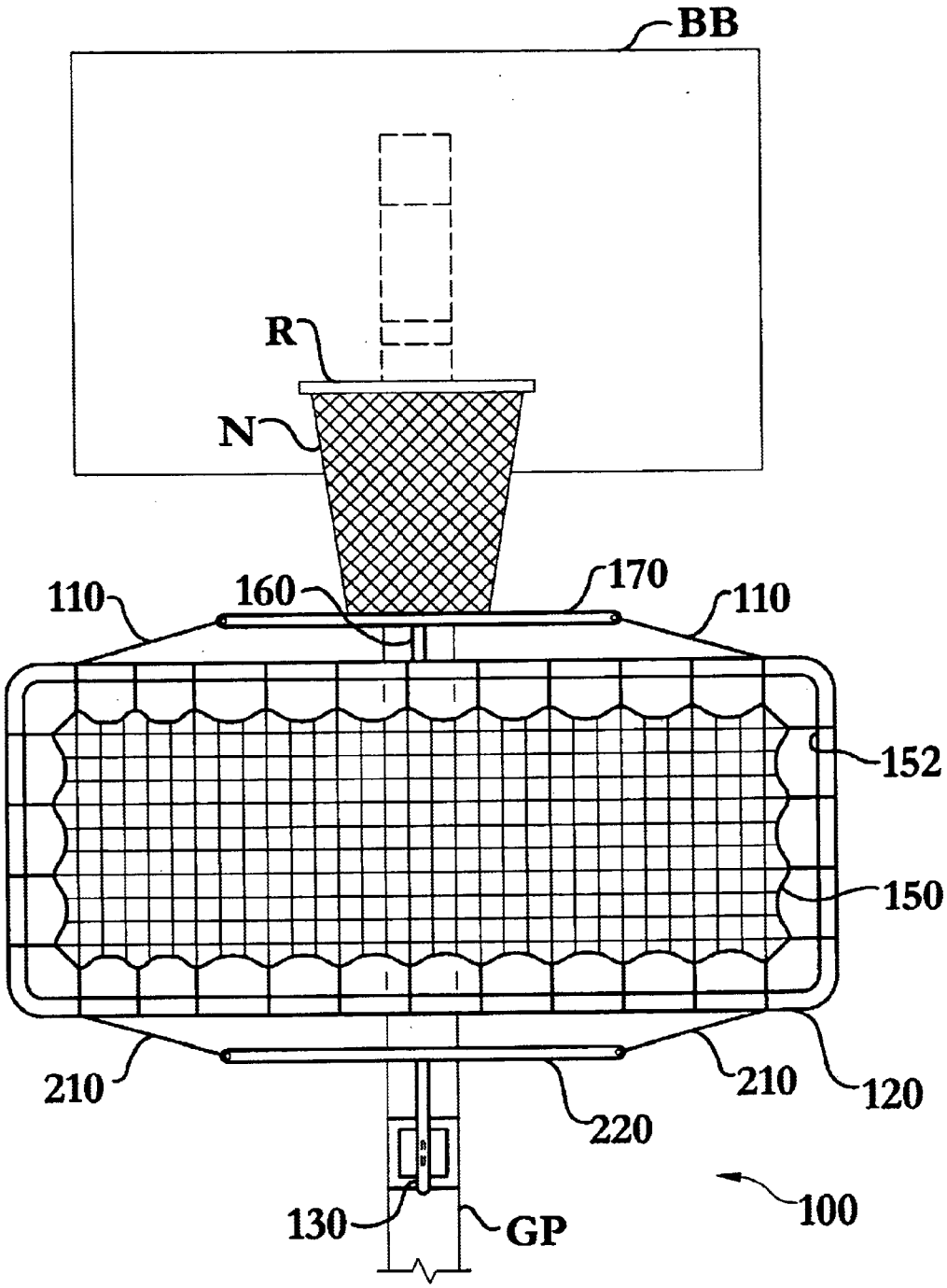
FIG. 6 is a detailed front elevation view, in reduced scale, of the basketball return apparatus shown in FIG. 5.

As shown in FIG. 5 and FIG. 6, additional variations may include alternative panel support assemblies 106 that may incorporate at least one support brace 130 having a distal end and a proximal end, at least one support brace goal assembly mounting device 140, and a lower retainer cross-member 220. The at least one retainer support brace's 130 distal end connects to the lower retainer cross-member 220, and the at least one support brace's 130 proximal end may be releasably and adjustably joined to the support brace goal assembly mounting device 140. Similar to the upper retainer cross-member 170, the lower retainer cross-member 220 functions solely as a spreader bar upon which the at least one lower panel elastic retainer 210 may be connected, as illustrated in FIG. 6. Additionally, the lower retainer cross-member 220 may be flexibly and adjustably joined to the resilient rebound panel 120 with at least one lower panel elastic retainer 210, given that the at least one lower panel elastic retainer 210 is elastic. Further, the connection is flexible given that the at least one lower retainer cross-member 200 is connected to the support brace 130, which is adjustable. An alternative embodiment, not shown, may not include the lower retainer cross-member 220, and the resilient rebound panel 220 may be flexible and adjustably attached to the at least one support brace 130 with at least one lower panel elastic retainer 210.

Figure 7:
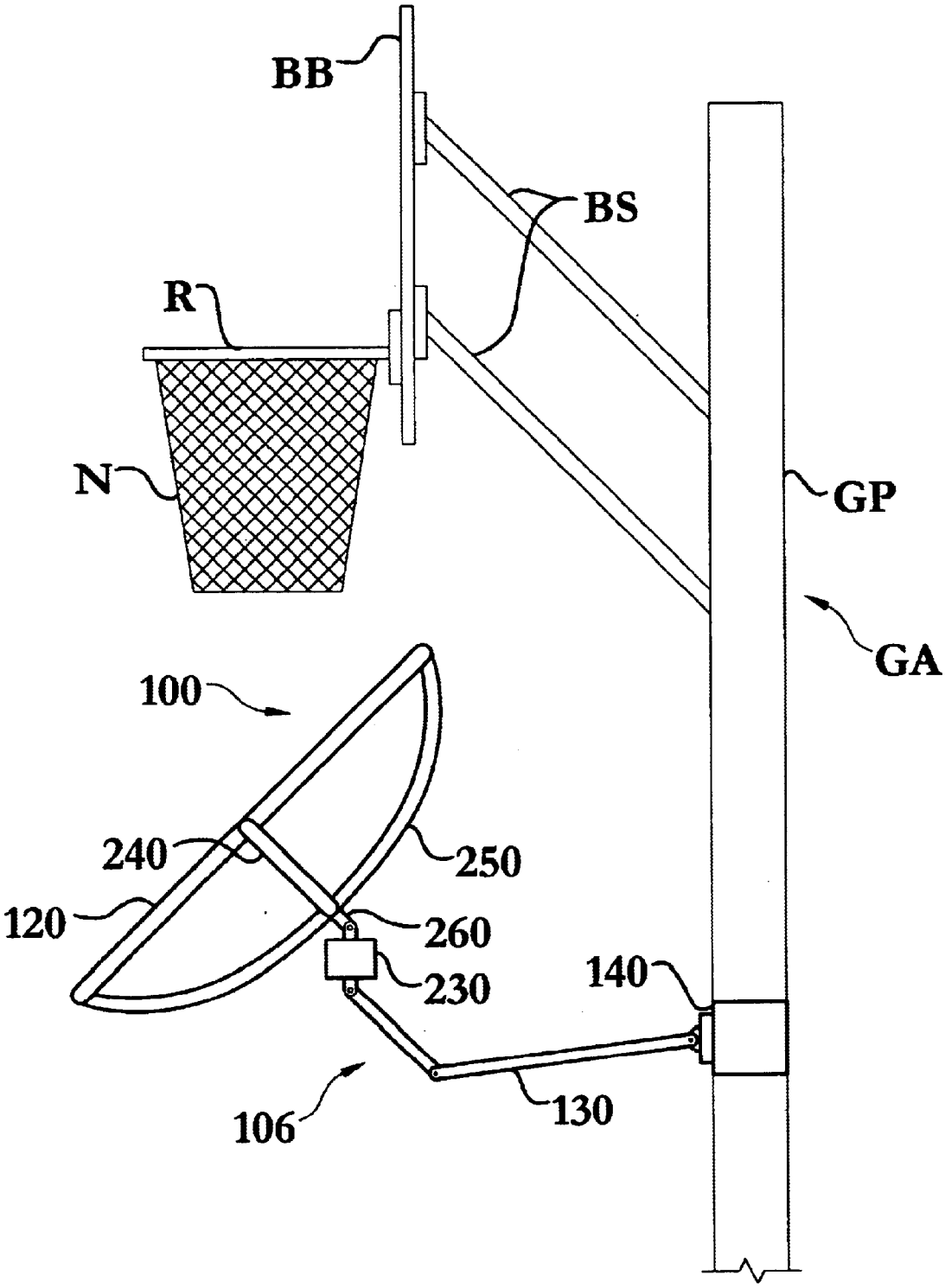
FIG. 7 is a detailed right side elevation view, in reduced scale, of a variation of the basketball return apparatus shown in FIG. 1.

Now referring to FIG. 7, a further variation the panel support assembly 106 may include at least one panel vertical frame cross member 250 connecting the resilient rebound panel 120 to an adjustable intermediate support brace 260, a torsion device 230 releasably and adjustably connecting the adjustable intermediate support brace 260 to at least one support brace 130, and a support brace goal assembly mounting device 140 releasably and adjustably connecting the at least one support brace 130 to the goal assembly GA. As with all embodiments of the present invention, the function of the panel support assembly 106 is to transfer the load of the apparatus to the goal assembly GA. As with prior embodiments, the panel support assembly 106 may be a single structural element, or may consists of multiple sections joined with joints to increase the adjustability of the apparatus 100. As seen in FIG. 7, the at least one panel vertical frame cross member 250 functions as an intermediate support frame for the resilient rebound panel 120 and transfers the loads exerted on the resilient rebound panel 120 to the torsion device 230 through the adjustable intermediate support brace 260. As one with skill in the art would understand, the torsion device 230 may be any device that when subjected to a rotational load absorbs the load, thereby creating and storing potential energy that is then released as kinetic energy as the torsion device 230 returns to the initial position. As one can appreciate, the most common torsion body 230 embodiment is one incorporating torsional springs. Thus when a basketball strikes the resilient rebound panel 120 the resilient rebound panel 120 absorbs a portion of the basketballs energy and the remaining energy causes the resilient rebound panel 120 to rotate about the torsion device 230. The torsion device 230 then releases stored potential energy to return the resilient rebound panel 120 to the initial location and in the process deflects the basketball substantially back in the direction from which it was thrown. The adjustable intermediate support brace 260 is adjustable so that the angle of the resilient rebound panel 120 may be adjusted without creating collisions between the panel vertical frame cross-member 250 and the torsion device 230 as the resilient rebound panel rotates. An additional panel horizontal frame cross-member 240 may be added to increase the strength of the apparatus 100.

Further, any of the preceding embodiments may include at least one articulable adjustable support brace joint 190 and at least one articulable adjustable retainer joint 200, as shown in FIG. 1, FIG. 3, FIG. 5, and FIG. 7. As one with skill in the art will easily recognize, the at least one articulable adjustable support brace joint 190 creates an adjustable pivot point in the support brace 130 so that a user can quickly and easily adjust the location and orientation of the resilient rebound panel 120. Similarly, the at least one articulable adjustable retainer joint 200 creates an adjustable pivot point in the retainer brace 160 so that a user can quickly and easily adjust the location and orientation of the resilient rebound panel 120. By definition, the brace joint 190 and the retainer joint 200 are places where two things or parts are joined. In other words, the brace joint 190 divides the support brace 130 into two sections and the retainer joint 200 divides the retainer brace into two sections. Having multiple sections that can rotate with respect to one another, hence articulate, and whose position can be releasably fixed, hence adjustable, further enhances the versatility of the apparatus 100. One with skill in the art can easily recognize a plurality of joints that will suffice in such a low load setting where ease of adjustment is paramount. One particular embodiment simply incorporates a quick release cam lever that permits quarter-turn release and locking engagement of the multiple sections. Such joints would allow the rebound panel 120 to be quickly and easily positioned beneath the backboard BB, as well as quickly and easily repositioned into a "storage position" that is out of the playing court and does not pose a danger to players. Additionally, adjustment of the articulable joints would allow the player to adjust the angle, and thereby the height, at which the ball is returned.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations for compatibility with the plurality of commercially available basketball goals. Accordingly, even though only few variations of the present invention are described herein, it is to be understood that the practice of such additional modifications and variations and the equivalents thereof, are within the spirit and scope of the invention as defined in the following claims.

The corresponding structures, materials, acts, and equivalents of all means or step plus function elements in the claims below are intended to include any structure, material, or acts for performing the functions in combination with other claimed elements as specifically claimed.

I claim:

1. A basketball return apparatus adjustably attachable to a basketball goal assembly, the goal assembly including a goalpost, at least one backboard support attached to a backboard and the goalpost, and a rim attached to the backboard, adapted to return a thrown basketball to a player, comprising:

a resilient rebound panel positioned beneath the backboard;

a panel retainer assembly having a plurality of upper panel elastic retainers adapted to elastically, flexibly, and adjustably connect the resilient rebound panel to the goal assembly; and a panel support assembly adapted to releasably adjustably connect the resilient rebound panel to the goal assembly such that the resilient rebound panel may rotate about a stationary position when impacted by a basketball thereby imparting tension in at least one of the plurality of upper panel elastic retainers, the tension quickly rotating the resilient rebound panel back to the stationary position and returning the basketball substantially in the thrown direction.

2. The apparatus according to claim 1, wherein the resilient rebound panel incorporates a resilient material secured to a rebound panel frame, the resilient material being under tension such that when impacted and deformed by a basketball the resilient material returns to the non-deformed position thereby further assisting in returning the basketball substantially in the thrown direction.

3. The apparatus according to claim 2, wherein the resilient material is an elasticized membrane.

4. The apparatus according to claim 2, wherein the resilient material is a plurality of interconnected elasticized cords.

5. The apparatus according to claim 1, wherein the resilient rebound panel is substantially rectangular having an upper left corner, an upper right corner, a lower left corner, and a lower right corner, and the plurality of upper panel elastic retainers includes an upper panel elastic retainer attached to each upper corner of the resilient rebound panel and a central point on the goal assembly below the level of the rim, and the panel support assembly is connected to the resilient rebound panel substantially at the midpoint between the lower left corner and the lower right corner thereby creating a pivot point.

6. The apparatus according to claim 1, wherein the panel support assembly incorporates at least one support brace goal assembly mounting device to releasably and adjustably join at least one support brace, having a distal end and a proximal end, to the goal assembly at the proximal end of the at least one support brace, and the at least one support brace connected to the resilient rebound panel at the distal end of the at least one support brace.

7. The apparatus according to claim 6, wherein the at least one support brace incorporates at least one articulable adjustable support brace joint.

8. The apparatus according to claim 1, wherein the panel retainer assembly incorporates at least one retainer brace goal assembly mounting device to releasably and adjustably join at least one retainer brace, having a distal end and a proximal end, to the goal post at the proximal end of the at least one retainer brace, and the at least one retainer brace connected to an upper retainer cross-member at the distal end of the at least one retainer brace, where the upper retainer cross-member is further flexibly and adjustably joined to the resilient rebound panel with the plurality of upper panel elastic retainers.

9. The apparatus according to claim 8, wherein the at least one retainer brace incorporates at least one articulable adjustable retainer brace joint.

10. The apparatus according to claim 1, wherein the panel retainer assembly incorporates at least one retainer brace goal assembly mounting device to releasably and adjustably join at least one retainer brace, having a distal end and a proximal end, to the goal post at the proximal end of the at least one retainer brace, and the at least one retainer brace connected to the plurality of upper panel elastic retainers at the distal end of the at least one retainer brace, where the at least one upper panel retainer is further flexibly and adjustably joined to the resilient rebound panel.

11. The apparatus according to claim 10, wherein the at least one retainer brace incorporates at least one articulable adjustable retainer brace joint.

12. The apparatus according to claim 1, wherein the panel support assembly incorporates at least one support brace goal assembly mounting device to releasably and adjustably join at least one support brace, having a distal end and a proximal end, to the goal assembly at the proximal end of the at least one support brace, and the at least one support brace connected to a lower retainer cross-member at the distal end of the at least one support brace, where the lower retainer cross-member is further flexibly and adjustably joined to the resilient rebound panel with a plurality of lower panel elastic retainers such tat when the resilient rebound panel rotates about the stationary position when impacted by a basketball thereby imparting tension in at least one of the plurality of upper panel elastic retainers and at least one of the plurality of tower panel elastic retainers, the tension in the at least one lower panel elastic retainer assists the tension in the at least one upper panel elastic retainer to quickly rotate the resilient rebound panel back to the stationary position and return the basketball substantially in the thrown direction.

13. The apparatus according to claim 12, wherein the at least one support brace incorporates at least one articulable adjustable support brace joint.

14. The apparatus according to claim 1, wherein the panel support assembly incorporates at least one support brace goal assembly mounting device to releasably and adjustably join at least one support brace, having a distal end and a proximal end, to the goal assembly at the proximal end of the at least one support brace, and the at least one support brace connected to a plurality of lower panel elastic retainers at the distal end of the at least one support brace, where the plurality of lower panel elastic retainer is further flexibly and adjustably joined to the resilient rebound panel such that when the resilient rebound panel rotates about the stationary position when impacted by a basketball thereby imparting tension in at least one of the plurality of upper panel elastic retainers and at least one of the plurality of lower panel elastic retainers, the tension in the at least one lower panel elastic retainer assists the tension in the at least one upper panel elastic retainer to quickly rotate the resilient rebound panel back to the stationary position and return the basketball substantially in the thrown direction.

15. The apparatus according to claim 14, wherein the at least one support brace incorporates at least one articulable adjustable support brace joint.

16. A basketball return apparatus adjustably attachable to a basketball goal assembly, the goal assembly including a goalpost, at least one backboard support attached to a backboard and the goalpost, and a rim attached to the backboard, adapted to return a thrown basketball to a player, comprising:

a resilient rebound panel positioned beneath the backboard; and a panel support assembly adapted to releasably and adjustably connect the resilient rebound panel to the goal assembly including at least one panel vertical frame cross member connecting the resilient rebound panel to an adjustable intermediate support brace, a torsion device releasably and adjustably connecting the adjustable intermediate support brace to at least one support brace, and a support brace goal assembly mounting device releasably and adjustably connecting the at least one support brace to the goal assembly such that the resilient rebound panel may rotate about a stationary position when impacted by a basketball thereby causing the torsion device to quickly rotating the resilient rebound panel bank to the stationary position and returning the basketball substantially in the thrown direction.

17. The apparatus according to claim 16, wherein the at least one support brace incorporates at least one articulable adjustable support brace joint.

18. The apparatus according to claim 17, wherein the resilient rebound panel incorporates a resilient material secured to a rebound panel frame, the resilient material being under tension such that when impacted and deformed by a basketball the resilient material returns to the non-deformed position thereby further assisting in returning the basketball substantially in the thrown direction.

19. A basketball return apparatus adjustably attachable to a basketball goal assembly, the goal assembly including a goalpost, at least one backboard support attached to a backboard and the goalpost, and a rim attached to the backboard, adapted to return a thrown basketball to a player, comprising:

a resilient rebound panel, incorporating a resilient material secured to a rebound panel frame, positioned beneath the backboard, the resilient material being under tension such that when impacted and deformed by a basketball the resilient material returns to the non-deformed position assisting in returning the basketball substantially in the thrown direction;

a panel retainer assembly, incorporating a plurality of upper panel elastic retainer, adapted to elastically, flexibly, and adjustably connect the resilient rebound panel to the goal assembly; and a panel support assembly, incorporating at least one support brace goal assembly mounting device to releasably and adjustably join at least one support brace, having a distal end and a proximal end, to the goal assembly at the proximal end of the at least one support brace, and the at least one support brace connected to the resilient rebound panel at the distal end of the at least one support brace, adapted to adjustably and releasably connect the resilient rebound panel to the goal assembly, such that the resilient rebound panel may rotate about a stationary position when impacted by a basketball thereby imparting tension in at least one of the plurality of upper panel elastic retainers, the tension quickly rotating the resilient rebound panel back to the stationary position and returning the basketball substantially in the thrown direction.

20. A basketball return apparatus adjustably attachable to a basketball goal assembly, the goal assembly including a goalpost, at least one backboard support attached to a backboard and the goalpost, and a rim attached to the backboard, adapted to return a thrown basketball to a player, comprising:

a resilient rebound panel, incorporating a resilient material secured to a rebound panel frame, positioned beneath the backboard;

a panel retainer assembly, incorporating at least one retainer brace goal assembly mounting device to adjustably and releasably join at least one retainer brace, having a distal end and a proximal end, to the goal assembly at the proximal end of the at least one retainer brace, and the at least one retainer brace connected to an upper retainer cross-member at the distal end of the at least one retainer brace, where the upper retainer cross-number is further elastically, flexibly, and adjustably joined to the resilient rebound panel with a plurality of upper panel elastic retainers adapted to releasably and adjustably connect the resilient rebound panel to the goal assembly; and a panel support assembly, incorporating at least one support brace goal assembly mounting device to releasably and adjustably join at least one support brace, having a distal end and a proximal end, to the goal assembly at the proximal end of the at least one support brace, and the at least one support brace connected to a lower retainer cross-member at the distal end of the at least one support brace, where the lower retainer cross-member is further joined to the resilient rebound panel with a plurality of lower panel elastic retainers adapted to flexibly and adjustably connect the resilient rebound panel to the goal assembly, such that when the resilient rebound panel rotates about the stationary position when impacted by a basketball thereby imparting tension in at least one of the plurality of upper panel elastic retainers and at least one of the plurality of lower panel elastic retainers, the tension the at least one lower panel elastic retainer assists the tension in the at least one upper panel elastic retainer to quickly rotate the resilient rebound panel back to the stationary position and return the basketball substantially in the thrown direction.

* * * * *